US009676074B2

(12) United States Patent
Kondoh

(10) Patent No.: US 9,676,074 B2
(45) Date of Patent: Jun. 13, 2017

(54) WORKING HEAD MOVING DEVICE

(71) Applicant: SEIBU JIDO KIKI CO., LTD., Osaka-shi, Osaka (JP)

(72) Inventor: Gisaburo Kondoh, Osaka (JP)

(73) Assignee: SEIBU JIDO KIKI CO., LTD., Osaka-Shi (JP)

( * ) Notice: Subject to any disclaimer, the term of this patent is extended or adjusted under 35 U.S.C. 154(b) by 155 days.

(21) Appl. No.: 14/535,027

(22) Filed: Nov. 6, 2014

(65) Prior Publication Data

US 2015/0266156 A1 Sep. 24, 2015

(30) Foreign Application Priority Data

Mar. 20, 2014 (JP) ..... 2014-058130

(51) Int. Cl.
*B24B 11/02* (2006.01)
*B24B 41/02* (2006.01)

(52) U.S. Cl.
CPC ..... *B24B 11/02* (2013.01); *B24B 41/02* (2013.01)

(58) Field of Classification Search
CPC ..... B24B 11/02; B24B 41/02; B24B 37/025; B24B 19/26
See application file for complete search history.

(56) References Cited

U.S. PATENT DOCUMENTS 3,111,789 A * 11/1963 Harmon ..... B24B 11/10 451/180
3,249,957 A * 5/1966 Secord ..... A63D 5/10 15/21.2
5,355,634 A * 10/1994 Araki ..... B25J 17/0208 451/24
5,613,896 A * 3/1997 Haus ..... A63D 5/10 451/112

FOREIGN PATENT DOCUMENTS

JP 4-135155 A 5/1992
JP 2002-086335 A 3/2002
JP 2012-71413 A 4/2012
JP 2012-240177 A 12/2012

* cited by examiner

*Primary Examiner* — Joseph J Hail
*Assistant Examiner* — Joel Crandall
(74) *Attorney, Agent, or Firm* — Birch, Stewart, Kolasch & Birch, LLP

(57) ABSTRACT

The working head moving device adopted in the working apparatus for machining workpiece supported by the work setting section having the underside-abutting portion and the side-abutting portion can maintain proper machining conditions with adaptability to decrease in size of workpiece entailed by proceeding of machining, can perform machining on workpiece with high uniformity and precision, and can move the working head without causing damage to workpiece. There is provided the head moving system for moving the working head between the working-state position and the retracted-state position, and the head moving (Continued)

system has the trunnion support portion which allows the working head to rock about its oscillation axis perpendicular to the rotation axis of the rotary tool when the working head is pressed against workpiece in conformity with decrease of workpiece size entailed by proceeding of machining, thereby maintaining the angle of intersection of workpiece-contacted surface and the rotation axis invariant.

3 Claims, 15 Drawing Sheets

WORKING HEAD MOVING DEVICE

CROSS-REFERENCE TO RELATED APPLICATION

The present application claims priority under 35 U.S.C. §119 to Japanese Patent Application No. 2014-58130, filed Mar. 20, 2014. The contents of this application are incorporated herein by reference in their entirety.

FIELD OF INVENTION

The present invention relates to a working head moving device suitable for use in a working apparatus for performing grinding, super-finishing, and so forth on a spherical body.

BACKGROUND OF THE INVENTION

In the course of the manufacture of spherical products, heretofore it has been customary to adopt a method involving a step of holding a plurality of workpieces (raw spherical bodies) by two parallel grinding plates in sandwich style and a step of effecting relative parallel movement of the two grinding plates to cause the workpieces to roll (to grind the entire spherical surfaces) for increasing the degree of sphericity.

In this regard the present applicants have developed a working apparatus which is highly adaptable to machining on workpieces of varying spherical diameters and is capable of performing grinding, super-finishing, and so forth with greater grinding precision, and already filed a patent application as to this apparatus (refer to Japanese Unexamined Patent Publication JP-A 2012-71413). As shown in FIG. 11, in this working apparatus 100, a workpiece (raw spherical body) W is placed on a support 101 constructed of a bearing or the like, and, the workpiece W is held from both sides of it by a pressing roller 102 and a pair of tapered rollers 103 in sandwich style. Then, a cup-type grinding wheel 104 is pressed from above against the workpiece W. The cup-type grinding wheel 104 is driven to rotate about an axis of rotation P perpendicular to the workpiece W-contacted surface (annular contacted part) thereof.

The paired tapered rollers 103 are placed in a uniaxial arrangement, with their smaller-diameter sides opposed to each other, thereby constituting a structure with a V-shaped groove formed at its outer periphery, like a pulley for V-belt. That is, the workpiece W is placed in straddle fashion over the inclined surfaces of the two tapered rollers 103 so as to be retained at its two points. An advantage of this construction is its capacity to handle variations in the spherical diameter of the workpiece W based on the adjustability to the face-to-face distance between the two tapered rollers 103 (the mutual distance in a direction perpendicular to the direction of drilling through the paper sheet with the drawing printed on it).

The paired tapered rollers 103 can be rotatably driven on an individual basis. For example, by rotating the two tapered rollers 103 at the same speed in the same direction, it is possible to allow the workpiece W to rotate regularly about a horizontal axis. On the other hand, with a difference in rotational speed between the two tapered rollers 103, a tilt is imparted to the axis of rotation of the workpiece W. Moreover, by increasing and decreasing the difference in rotational speed between the two tapered rollers 103, it is possible to tilt the axis of rotation of the workpiece W at various angles. Therefore, by continuing such a control to vary the rotational-speed difference, it is possible to impart complex rotary motion to the workpiece W, so that the entire surface (spherical surface) of the workpiece W can pass thoroughly through a location where machining is carried out by the cup-type grinding wheel 104 (contact location). It can thus be said that the two tapered rollers 103 constitute a spheric-rotation driving section 105 for machining (grinding) the entire surface of the workpiece W thoroughly.

In the following specification, the complex rotary motion caused by tilting the axis of rotation of the workpiece W at various angles to perform thorough machining on the entire surface of the workpiece W will be referred to as "spheric rotation".

In the working apparatus 100, the support 101 serves as an "underside-abutting portion" which supports the workpiece W, and the tapered roller 103 pair serves as a "side-abutting portion" which abuts on the workpiece W to stop its side-to-side movement. That is, the "underside-abutting portion" and the "side-abutting portion" constitute a work setting section 106 for effecting positioning of the workpiece W. Moreover, the pressing roller 102 serves as a "stopper" for retaining the workpiece W to prevent it from being separated from the "side-abutting portion". It is desirable to add this "stopper" to the construction in the interest of uniqueness and reliability in the positioning of the workpiece W effected by the work setting section 106.

In the working apparatus 100 thusly constructed, when the workpiece W is attached to and detached from the work setting section 106, there is a need to move the cup-type grinding wheel 104 to a retracted position from the machining position. In light of this, for example, a mechanism for moving the cup-type grinding wheel 104 and its rotatably driving section (not shown in the drawings) as well in a direction along the axis of rotation P was adopted (for example, there is known a mechanism for raising and lowering a grinding tool in a vertical direction as disclosed in Japanese Unexamined Patent Publication JP-A 4-135155 (1992).

SUMMARY OF THE INVENTION

In the working apparatus 100 of conventional design, the workpiece W supported on the work setting section 106 becomes smaller and smaller (in diameter) as machining (grinding, super-finishing, and so forth) proceeds. At this time, since the workpiece W is subjected to the action of the pressing roller 102, it follows that both the contact with the support 101 serving as the "underside-abutting portion" and the contact with the tapered rollers 103 serving as the "side-abutting portion" are maintained, and a spherical center S moves in a direction N along a bisector drawn between the two contact locations. That is, as slightly exaggerated for purposes of illustration in FIG. 12, a situation occurs in which the top part of the workpiece W runs obliquely downwardly away from the cup-type grinding wheel 104.

In this case, if only the mechanism for allowing movement along the axis of rotation P is adopted for the cup-type grinding wheel 104, a one-sided contact phenomenon, namely a phenomenon in which the cup-type grinding wheel 104 is only partly (only at its left end as viewed in FIG. 12) brought into contact with the workpiece W, will take place, which gives rise to a problem of difficulty in performing machining on the workpiece W with high degrees of uniformity and precision.

Meanwhile, with the aim of solving this problem, for example, let it be assumed that there is adopted a mechanism for moving (raising and lowering) the cup-type grinding wheel 104 while rocking it about a position Q established as a pivotal point at some point above the tapered roller 103 as shown in FIG. 11. In this case, however, as shown in FIG. 13, the cup-type grinding wheel 104 may interfere with the workpiece W when it is moved upward, which leads to a problem of occurrence of damage to the workpiece W.

The present invention has been devised in view of the circumstances as mentioned supra, and accordingly an object of the present invention is to provide a working head moving device adopted in a working apparatus for performing machining such as grinding and super-finishing on a workpiece supported on a work setting section having an underside-abutting portion and a side-abutting portion, the working head moving device being characterized in that it is capable of maintaining proper machining conditions with adaptability to a decrease in size of the workpiece entailed by proceeding of machining process, is capable of performing machining on the workpiece with high degrees of uniformity and precision, and is capable of moving a working head without causing any damage to the workpiece.

In order to accomplish the above object, the present invention takes the following measures.

That is, a working head moving device pursuant to the present invention comprises: a work setting section for effecting positioning of a workpiece by means of an underside-abutting portion which supports a workpiece, and a side-abutting portion which abuts on the workpiece supported on the underside-abutting portion to stop its side-to-side movement; a working head in which a rotary tool is brought into contact with the workpiece positioned by the work setting section, and the rotary tool is driven to rotate about an axis of rotation perpendicular to a workpiece-contacted surface of the rotary tool; and a head moving system for moving the working head between a working-state position for machining the workpiece positioned by the work setting section by the rotary tool and a retracted-state position for separating the working head from the workpiece. The head moving system is provided with a trunnion support portion which allows the working head to rock about an axis of oscillation perpendicular to the axis of rotation when the working head is pressed against the workpiece positioned by the work setting section in conformity with a decrease in size of the workpiece entailed by proceeding of machining process, thereby maintaining an angle of intersection of the workpiece-contacted surface and the axis of rotation invariant.

The workpiece is a spherical body, and it is advisable that the work setting section is provided with a spheric rotation driving section for imparting a rotative force to the workpiece so that the entire spherical surface of the workpiece can be brought into contact with the rotary tool of the working head.

It is preferable that the head moving system comprises: a rocking lever with the working head disposed at its lever front end; and a rocking base part for rockably holding that part of the rocking lever which is spaced away from the lever front end in a lever length direction, and that the trunnion support portion is situated in a junction of the lever front end of the rocking lever and the working head.

It is preferable that the rocking lever is provided with: a driven link disposed so as to protrude radially with respect to the trunnion support portion for rocking movement together with the working head in unitary relation; a base link disposed so as to protrude radially with respect to the rocking base part, for maintaining an angle of protrusion with respect to the rocking base part constant at least before the rocking lever moves the working head to the retracted-state position; and a transmission link for coupling the base link and the driven link so that they become parallel and equal in length, for constituting a parallel link mechanism.

It is preferable that the parallel link mechanism is provided with an operation switching section for allowing switching between enabling and disabling of oscillating movement of the working head relative to the rocking lever.

It is preferable that the rocking lever is coupled with a rocking unit for imparting a rocking force, and the rocking unit is constructed of: a movement driving section for moving the working head between the working-state position and the retracted-state position relative to the workpiece positioned by the work setting section; and a pressurization driving section for pressing the working head in the working-state position against the workpiece, these driving sections being coupled together in a serial arrangement, and that the movement driving section is constructed of an actuator which is operated with a compressible fluid used as an operation source, and the pressurization driving section is constructed of an actuator which is operated with a compressible fluid used as an input source, and with an incompressible fluid used as an operation source.

According to the present invention, the working head moving device adopted in the working apparatus for performing machining such as grinding and super-finishing on a workpiece supported on the work setting section having the underside-abutting portion and the side-abutting portion is capable of maintaining proper machining conditions with adaptability to a decrease in size of the workpiece entailed by proceeding of machining process, is capable of performing machining on the workpiece with high degrees of uniformity and precision, and is capable of moving the working head without causing any damage to the workpiece.

DESCRIPTION OF THE EMBODIMENTS

Hereinafter, embodiments of the present invention will be explained with reference to drawings.

FIGS. 1 to 10B show a working head moving device 1 in accordance with one embodiment of the present invention. This embodiment will be described in respect of a case where a raw spherical body is a workpiece W. Moreover, this embodiment will be described in respect of a case where the working head moving device 1 pursuant to the present invention is incorporated in a working apparatus 2 for performing spherical-surface polishing process such as grinding and super-finishing on the workpiece W.

Figure 1:
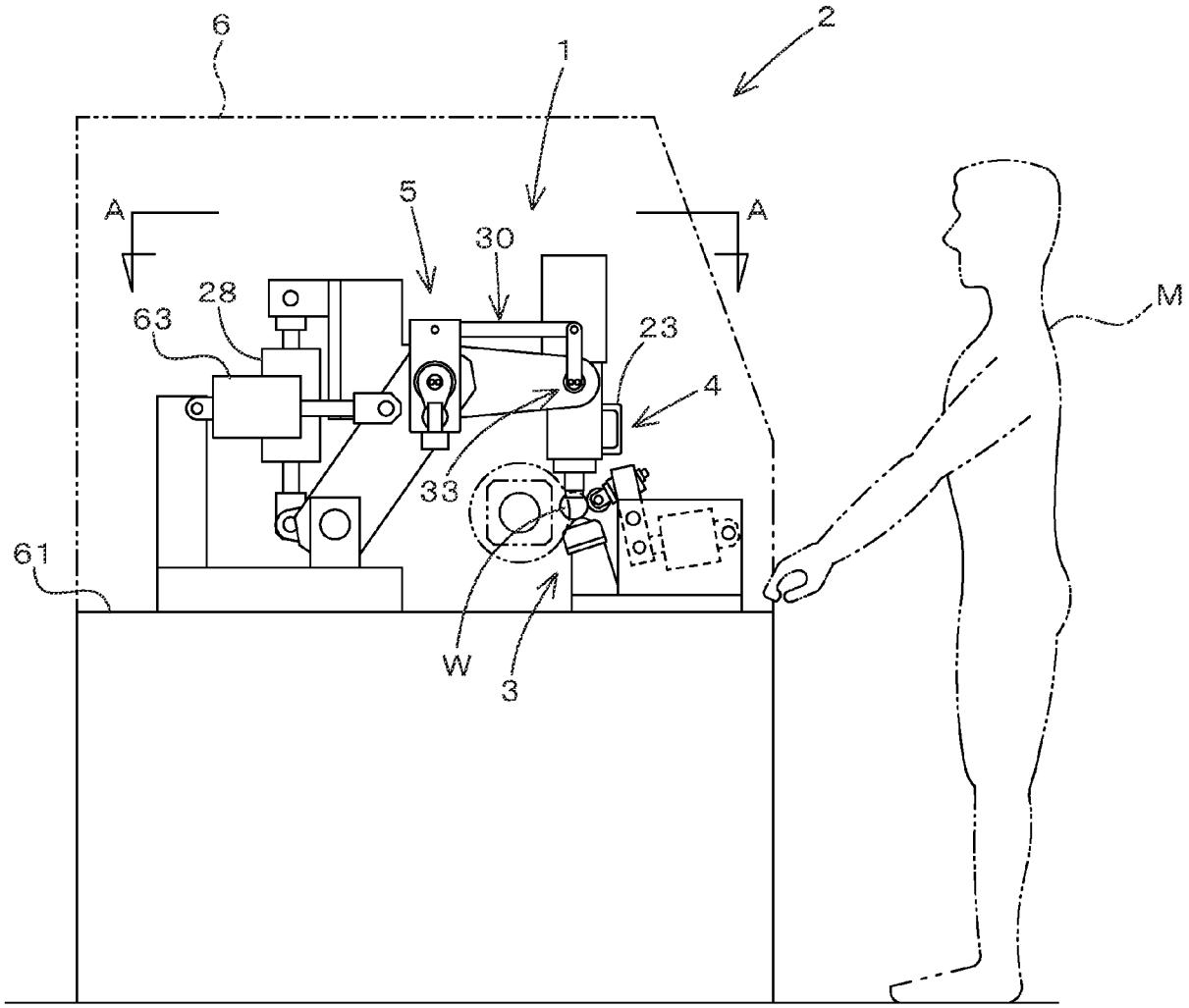
FIG. 1 is a side view of a working apparatus equipped with a working head moving device pursuant to the present invention.

As shown in FIG. 1, the working head moving device 1 pursuant to the present invention comprises: a work setting section 3 for effecting positioning of the workpiece W; a working head 4 for performing machining on the workpiece W held by the work setting section 3; and a head moving system 5 for moving the working head 4 relative to the workpiece W. The upper half of the apparatus is covered with a cover 6 which is made transparent in part or in entirety so that working conditions can be visually checked from outside. The provision of the cover 6 makes it possible to keep a working atmosphere clean mainly in a region around the workpiece W, as well as to achieve prevention of scattering of polishing fluids, protection from dust, sound insulation, improvement in appearance, protection for an operator M, and so forth.

The work setting section 3 and the working head 4 are substantially the same as those equipped in the working apparatus as disclosed in JP-A 2012-71413, and will thus be described first.

Figure 6A:
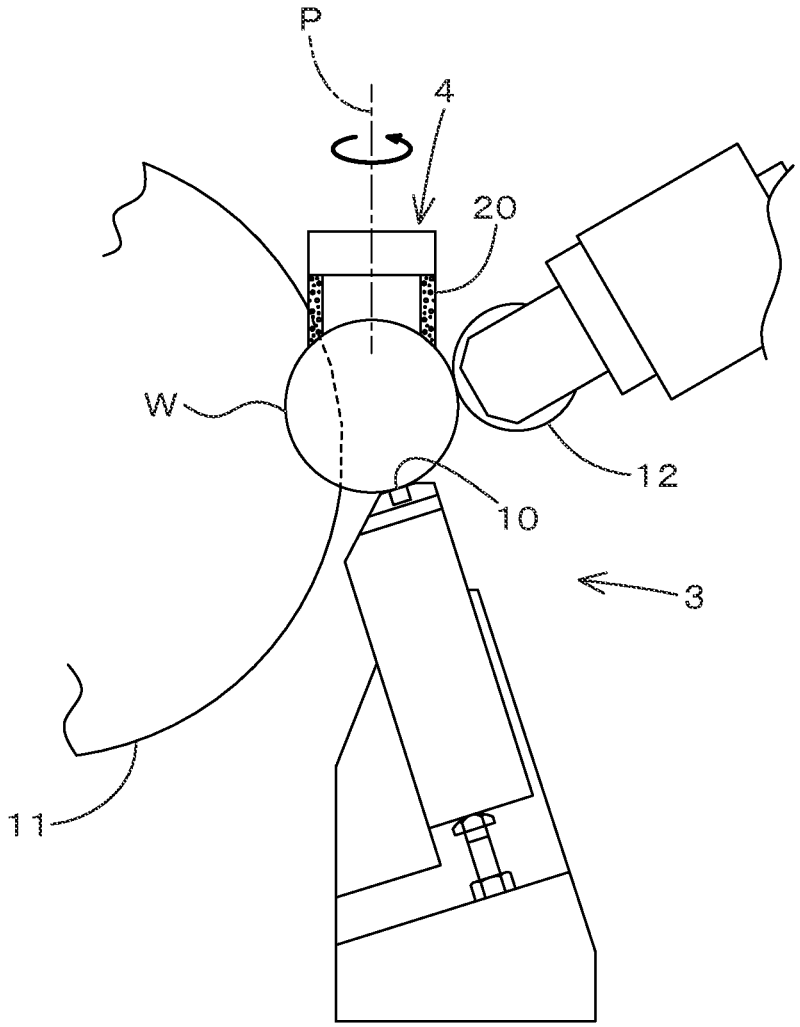
FIG. 6A is a side view showing a work setting section having a shoe-type underside-abutting portion.
Figure 6B:
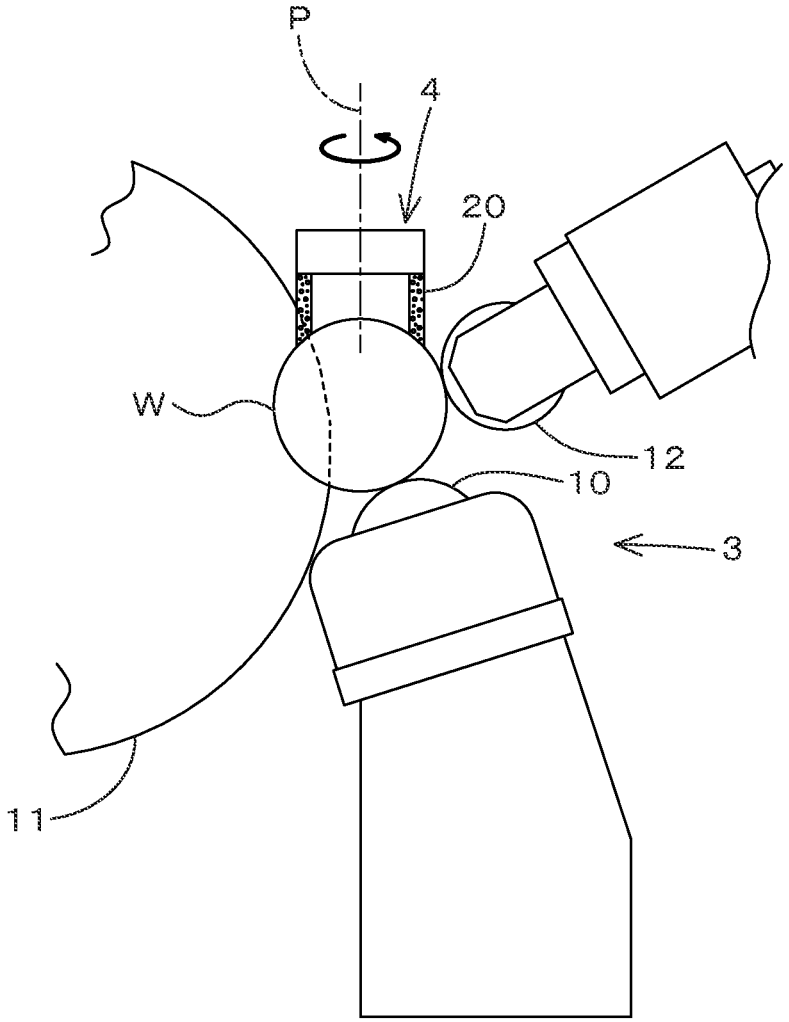
FIG. 6B is a side view showing a work setting section having a ball-type underside-abutting portion.

As shown in FIG. 6A or 6B, the work setting section 3 comprises: an underside-abutting portion 10 which receives and supports the workpiece W from below; and a side-abutting portion 11 which abuts on the workpiece W supported on the underside-abutting portion 10 to stop its side-to-side movement. In addition, the work setting section 3 includes a stopper portion 12 which holds the workpiece W positioned by the underside-abutting portion 10 and the side-abutting portion 11 in conjunction with the side-abutting portion 11.

Figure 7:
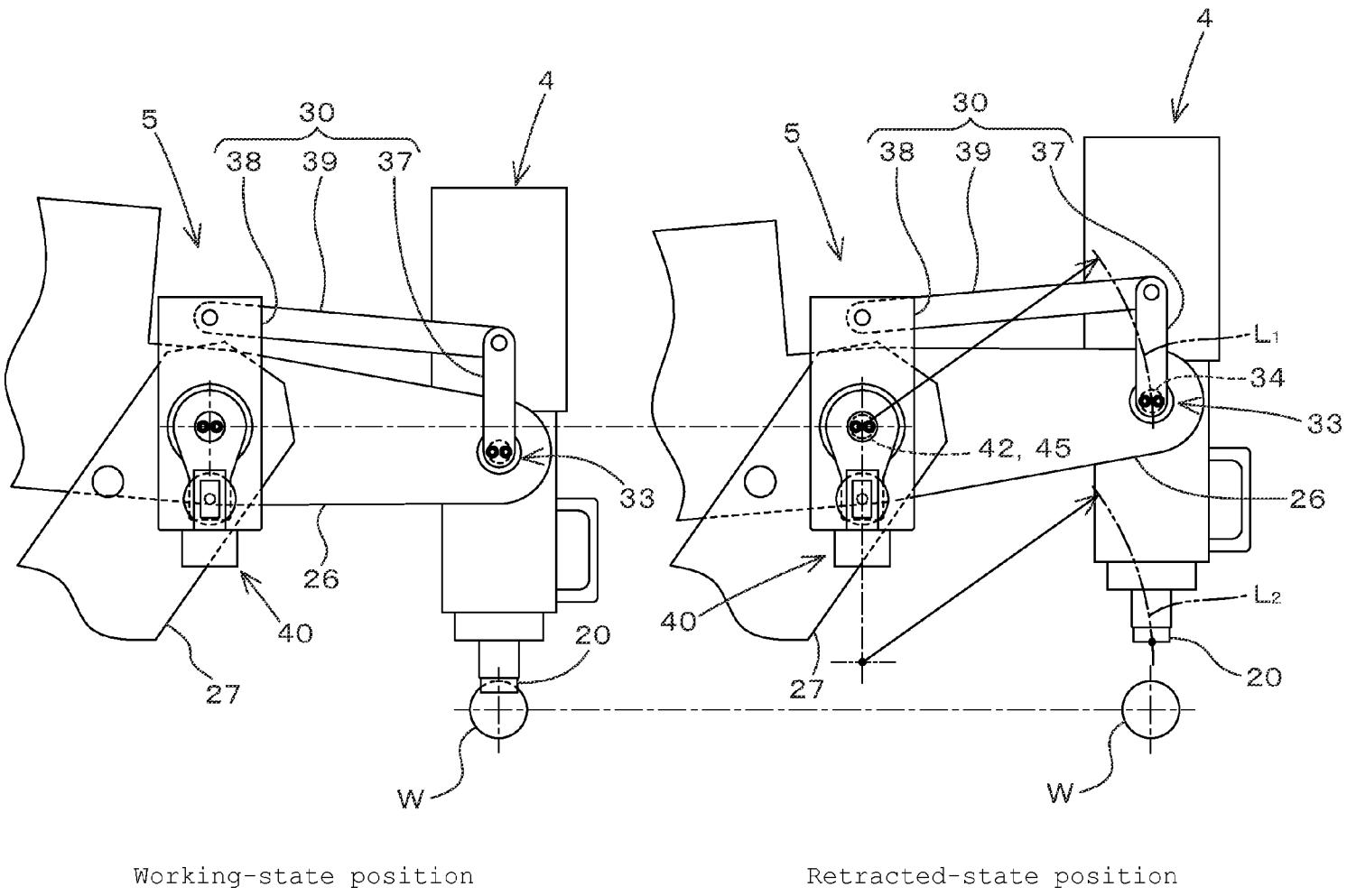
FIG. 7 is a side view showing a condition of operation of the working head moving device of the present invention in a working-state position and in a retracted-state position.

The underside-abutting portion 10 may either be of a shoe type for holding the workpiece W for free sliding motion with less friction as shown in FIG. 6A, or be of a ball type for holding the workpiece W by a spherically rotating ball as shown in FIG. 6B. Alternatively, a type for holding the workpiece W by a bearing or the like may also be adopted (refer to a numerical symbol 9 as shown in FIG. 7 of JP-A 2012-71413).

Figure 2:
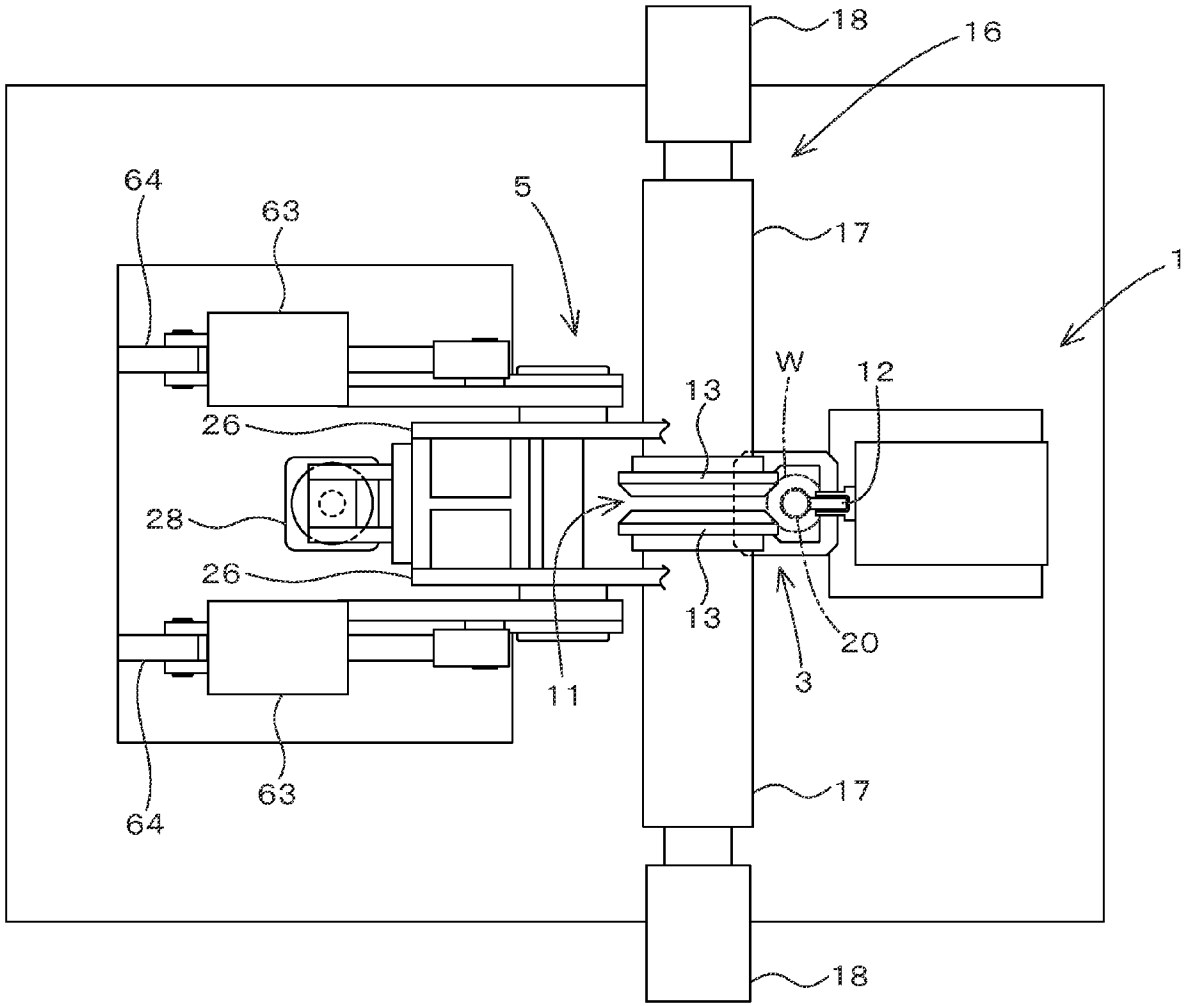
FIG. 2 is a view taken along the line indicated by arrow A-A shown in FIG. 1 (with a working head omitted).

On the other hand, as shown in FIG. 2, the side-abutting portion 11 is constructed by placing a pair of tapered rollers 13 in a uniaxial arrangement so that their smaller-diameter sides are opposed to each other. The outer periphery of the tapered roller 13 pair is formed with a V-shaped groove defined by the mutually opposed inclined surfaces of the two tapered rollers 13. The workpiece W is retained within the V-shaped groove while being restrained against side-to-side movement (which refers to movement to the left of FIG. 2).

Since the face-to-face distance between the tapered rollers 13 can be varied, by making adjustment to the distance, it is possible to handle variations in the spherical diameter of the workpiece W satisfactorily. As employed herein, the term "spherical diameter variations" refers to, in addition to various sized workpieces W as a matter of course, a decrease in size of the workpiece W entailed by proceeding of machining process. Such an adjustability to the face-to-face distance between the tapered rollers 13 is also useful in, when wear occurs in the tapered roller 13, setting the workpiece W in a predetermined position in accordance with the extent of the wear.

These tapered rollers 13 constituting the side-abutting portion 11 also constitute a spheric rotation driving section 16 for permitting spheric rotation of the workpiece W. That is, each of the tapered rollers 13 is rotatably retained via a bearing portion 17, and is connected with a driving portion 18 capable of highly precise control such as a servomotor for individual drive control, and more specifically the tapered rollers 13 can be rotated either in the same direction or in different directions, as well as either at the same speed or at different speeds. Therefore, through the operation of each of the driving portions 18, it is possible to allow the workpiece W to rotate regularly about a horizontal axis by rotating the tapered rollers 13 at the same speed in the same direction, as well as to permit spheric rotation of the workpiece W by causing a difference in rotational speed between the tapered rollers 13.

The working head 4 has a rotary tool 20 such for example as a cup-type grinding wheel (refer to FIGS. 6A and 6B) mounted in an annular bottom-downward fashion. The rotary tool 20 is rotatably driven by a rotatably driving portion 21 disposed above it (refer to FIG. 3, for example). Therefore, in the working head 4, when the bottom part (annular part) of the rotary tool 20 is brought into contact with the workpiece W positioned by the work setting section 3, the rotary tool 20 is driven to rotate about an axis of rotation P perpendicular to its workpiece-contacted surface, whereby the workpiece W can be subjected to grinding process.

As shown in FIG. 1, the working head 4 is fitted with a handle 23 protruding forward (toward the operator M) in front of the operator M. The operator M is able to move the rotary tool 20 in contact with and away from the workpiece W positioned by the work setting section 3 simply by raising and lowering the working head 4 with his/her hand gripping the handle 23.

Next, the head moving system 5 will be explained.

The head moving system 5 is a mechanism for holding the working head 4 so as to be movable between a working-state position and a retracted-state position. That is, through the movement of the working head 4 effected by the head moving system 5, the rotary tool 20 can be brought into contact with the workpiece W positioned by the work setting section 3, and at this time pressure can be applied to the workpiece W as required for machining process, and also the rotary tool 20 can be moved away from the workpiece W.

Figure 3:
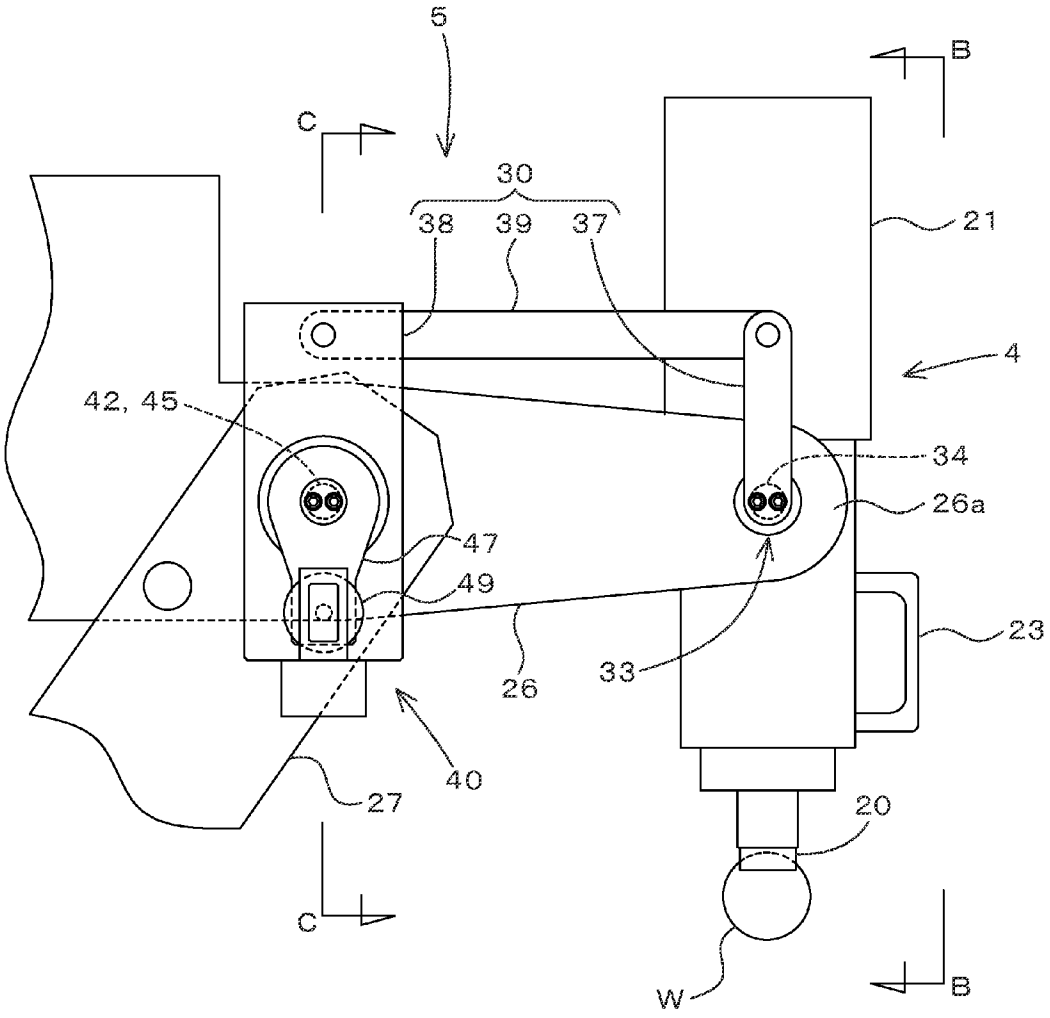
FIG. 3 is a side view showing the principal part of the working head moving device of the present invention.

As shown in FIG. 3, the head moving system 5 comprises: a rocking lever 26; a rocking base part 27 for rockably holding the rocking lever 26; and a rocking unit 28 for imparting a rock drive to the rocking lever 26 (refer to FIG. 1).

The rocking base part 27 is placed in a position midway between the ends of the rocking lever 26 in the direction of the length of the lever. A rocking shaft 45 for holding the rocking lever 26 for free rocking motion relative to the rocking base part 27 is given a sufficiently large thickness. Moreover, a mechanism to support the rocking shaft 45 by a tapered roller bearing 46 is adopted for use in the rocking base part 27. This makes it possible to support the rocking shaft 45 in a thrust direction (axial direction) and a radial direction rigidly with high stability.

The above-described working head 4 is located relative to one end of the rocking lever 26 spaced away from the position to be held by the rocking base part 27 in the lever length direction (right-hand end as viewed in FIG. 3, which will hereafter be referred to as "lever front end 26*a*"). On the other hand, the above-described rocking unit 28 is located relative to the other end of the rocking lever 26 spaced away from the position to be held by the rocking base part 27 in the lever length direction. Moreover, the rocking lever 26 is provided with a parallel link mechanism 30 extending across the position to be held by the rocking base part 27 and the lever front end 26*a*.

Figure 4:
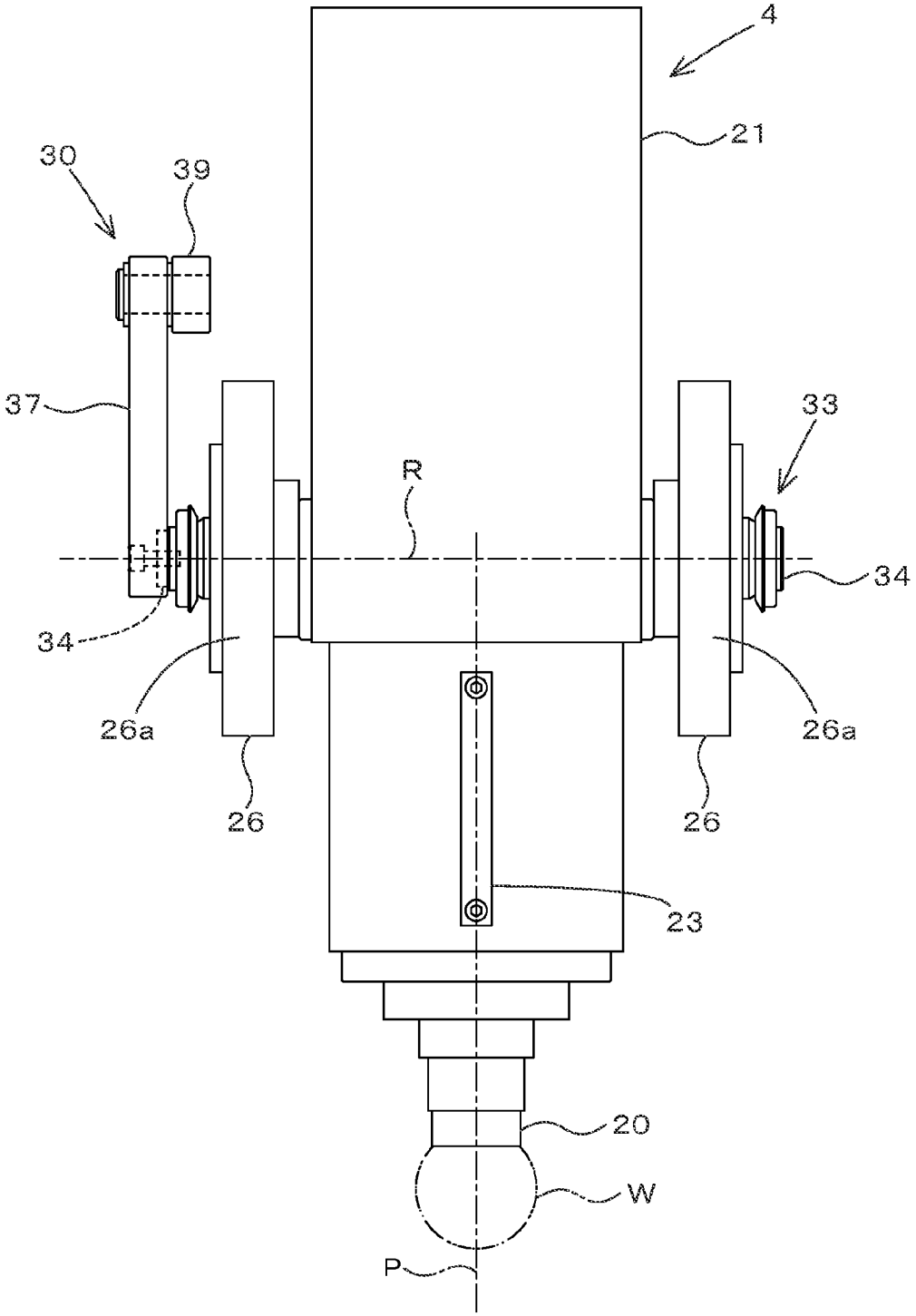
FIG. 4 is a view taken along the line indicated by arrow B-B shown in FIG. 3.

As shown in FIG. 4, a pair of right and left rocking levers 26 is disposed in a manner such that the working head 4 is held at its right and left sides by the rocking levers (sandwiched between the rocking levers in a right-left direction in sight of the operator M as shown in FIG. 1, which will hold for the following description). Also, the above-described rocking unit 28 is so disposed as to hold between the paired right and left rocking levers 26 (refer to FIG. 2).

A trunnion support portion 33 is disposed in a junction of the working head 4 and the lever front end 26*a* of the rocking lever 26. The trunnion support portion 33 is configured so that uniaxially arranged pivot shafts 34 protruding rightward and leftward from the working head 4 can be rotatably supported by bearing portions arranged on the right and left sides of the working head 4 (although not shown in the drawings, the bearing portion is installed in the lever front end 26*a* of the rocking lever 26). This allows the working head 4 to rock about an axis of oscillation R perpendicular to the rotation axis P of the rotary tool 20.

In the working head 4 which can be freely rocked by the trunnion support portion 33, even with a gradual decrease of the size of the workpiece W positioned by the work setting section 3 entailed by proceeding of machining process, the angle of intersection of the workpiece W-contacted surface of the rotary tool 20 and the rotation axis P of the rotary tool 20 can be maintained invariant. That is, the rotary tool 20 can be kept in pressure-contact with the workpiece W at a constant intersection angle in the course of machining process.

So long as the rotary tool 20 is a cup-type grinding wheel (having an annular bottom end face) and the workpiece W is a spherical body, the intersection angle as mentioned herein invariably stands at 90 degrees, because the rotation axis P of the rotary tool 20 is set so as to pass through the spherical center of the workpiece W. However, the intersection angle is not always 90 degrees, depending on the form of the rotary tool 20 and the shape of the workpiece W (a part to be machined).

Figure 5:
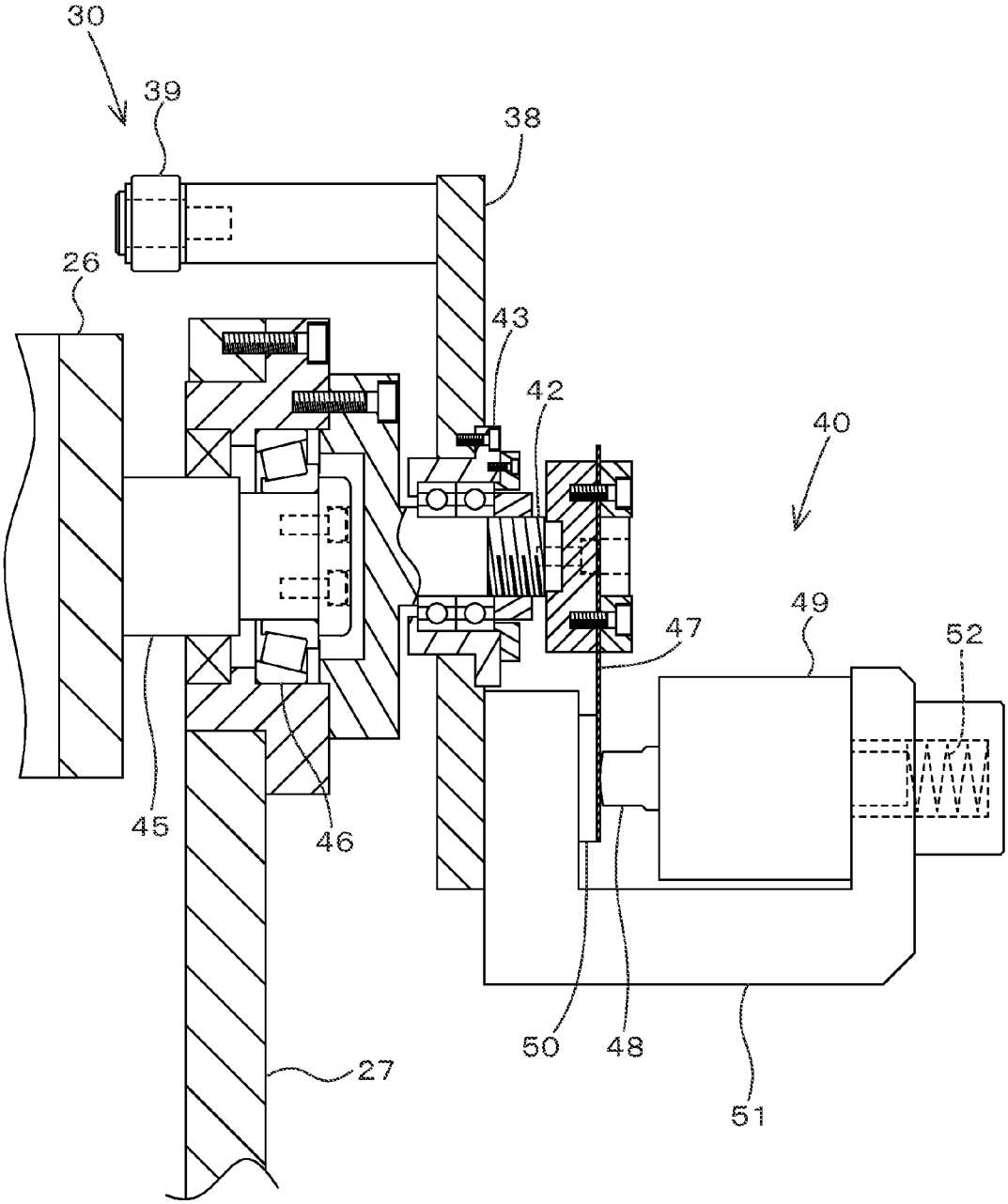
FIG. 5 is a sectional view taken along the line indicated by arrow C-C shown in FIG. 3.

As shown in FIGS. 3 to 5, the parallel link mechanism 30 comprises: a driven link 37; a base link 38; and a transmission link 39. These links 37, 38, and 39 are coupled together so as to define a parallelogram on the basis of the rocking lever 26 (given that the rocking lever 26 acts as a fixed link). The parallel link mechanism 30 is provided with an operation switching section 40.

As shown in FIGS. 3 and 4, the driven link 37 is coupled to the shaft end of the pivot shaft 34 of the working head 4 so as to be unrotatable relative to the pivot shaft 34. That is, the driven link 37 is so disposed as to protrude in a radial direction (upward direction as viewed in FIGS. 3 and 4) with respect to the trunnion support portion 33. When the working head 4 is rocked relative to the rocking lever 26 under the action of the trunnion support portion 33, the driven link 37 and the working head 4 are rocked in unitary relation.

As shown in FIG. 5, the base link 38 is attached to a base shaft 42 unrotatably disposed so as to protrude leftward (rightward as viewed in FIG. 5) from the rocking base part 27 via a bearing body 43 rotatably held by the base shaft 42. In sum, the base link 38 is so disposed as to protrude radially with respect to the rocking base part 27, and is, in principle, held to the rocking base part 27 for free rocking motion about the base shaft 42.

The base shaft 42, while being disposed in coaxial relation to the rocking shaft 45 for holding the rocking lever 26 for free rocking motion relative to the rocking base part 27 (uniaxial arrangement), is not coupled to the rocking shaft 45.

The transmission link 39, which is intended to provide coupling between the tip of the driven link 37 (refer to FIG. 4) and the tip of the base link 38 (refer to FIG. 5), is designed so that the driven link 37 and the base link 38 become parallel and equal in length, and that a distance between the coupled links 37 and 38 is equal to a center distance between the rocking center of the driven link 37 (pivot shaft 34) and the rocking center of the base link 38 (base shaft 42) (viz. the length of the fixed link). As a matter of course, the transmission link 39 and the two links 37 and 38 are coupled together for free individual joint motion (rocking motion).

Meanwhile, as shown in FIGS. 3 and 5, the operation switching section 40 comprises: a radially-outwardly extending brake plate 47 attached to the base shaft 42 unrotatably protruding from the rocking base part 27 so as not to be rotatable (not to be unitarily rotatable) relative to the base shaft 42; a brake drive source 49 for advancing and retracting a clamp rod 48, and more specifically moving the clamp rod 48 toward and away from the brake plate 47; and a clamp mount 50 for clamping the brake plate 47 in conjunction with the clamp rod 48 when the brake drive source 49 is operated to advance the clamp rod 48. The clamp mount 50 is secured to a bracket 51 for attachment of the brake drive source 49 to the base link 38.

The brake drive source 49 is intended to move the clamp rod 48 toward and away from the clamp mount 50 by means of a fluid pressure cylinder, an electromagnet, an electric motor, or otherwise. In this structure, as safety measures against troubles such as a power failure, the clamp rod 48 is normally urged in an advancing direction by a spring 52, and the brake plate 47 is pressed against the clamp mount 50 to produce a braking effect (the condition where this braking effect is produced will hereafter be referred to as a "lock condition" of the brake plate 47). In sum, during the time the brake drive source 49 is in a deactivated state, the brake plate 47 is in the lock condition, and, when the brake drive source 49 is set in motion, the lock condition of the brake plate 47 is released.

In the parallel link mechanism 30 designed to include such an operation switching section 40, in the operation switching section 40, when the brake plate 47 is brought into the lock condition by deactivating the brake drive source 49, a lock is applied so that the base shaft 42 and the base link 38 are restrained against relative rotation, with the consequence that the base link 38 maintains the angle of protrusion with respect to the rocking base part 27 constant (unrotatably locked).

That is, as shown in FIGS. 7A and 7B, the mutually locked relation between the base link 38 and the rocking base part 27 is maintained regardless of the way of rocking motion of the rocking lever 26 (without being influenced by the rocking motion of the rocking lever 26). In this regard, since the parallel link mechanism 30 basically has the function of keeping the driven link 37 and the base link 38 in parallel with each other, it follows that the parallel relation between the driven link 37 and the base link 38 is also maintained without being influenced by the rocking motion of the rocking lever 26.

On the other hand, the working head 4 is held for free oscillating motion to the rocking lever 26 via the trunnion support portion 33, and, the driven link 37 and the working head 4 are coupled together in unitarily rockable relation. Therefore, when the rocking lever 26 is rocked up and down while defining a rocking path $L_1$ in the form of an arc about the rocking shaft 45 acting as a pivotal point to move the working head 4 upward and contrarily downward, then the base link 38 and the driven link 37 are kept in parallel with each other, and the angular relation between the driven link 37 and the working head 4 is maintained invariant. That is, the rotary tool 20 of the working head 4 moves up and down while defining a rocking path $L_2$ having the same radius of curvature as that of the arcuate rocking path $L_1$ defined by the rocking lever 26, and, its separation from the workpiece W (upward movement) and contact with the workpiece W (downward movement) are effected in accordance with this rocking path $L_2$.

Figure 8:
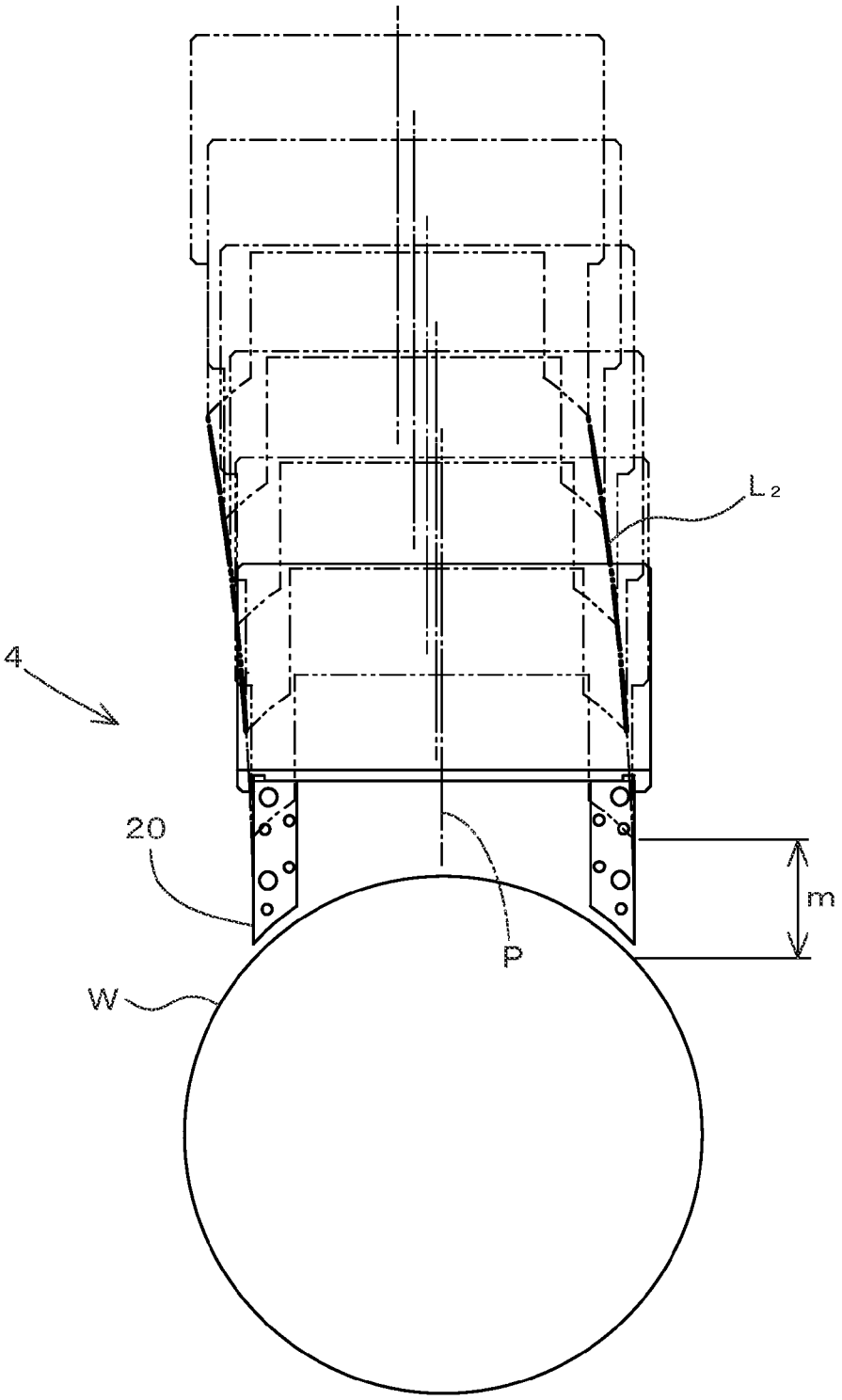
FIG. 8 is a view of a rotary-tool path, illustrating in enlarged dimension how a rotary tool is to be separated from a workpiece positioned by the work setting section as the working head is moved upward.

FIG. 8 shows in enlarged dimension how the rotary tool 20 is to be separated from the workpiece W positioned by the work setting section 3 as the working head 4 moves upward while defining the arcuate rocking path $L_2$. As is apparent from FIG. 8, the arcuate rocking path $L_2$ defined by the rotary tool 20 is gradually displaced backward (leftward as viewed in FIG. 8) in a gentle arc form as the rotary tool 20 moves upward from the position of contact with the workpiece W as a starting point. That is, upon the rotary tool 20 being moved upward from the workpiece W, the circumference of the bottom end of the rotary tool 20 (annular part of the cup-type grinding wheel) is instantaneously separated in whole from the spherical surface of the workpiece W, and goes at a dash over a height m determined so that the bottom end will not make contact with the workpiece W any longer even if oscillating motion is imparted to the rotary tool 20 (no oscillating motion is imparted in reality).

Such an arcuate rocking path is obviously different from the retracting path (in the form of a downwardly convex arc) of the cup-type grinding wheel 104, which has already been described with reference to FIG. 13 in relation to a measure to avoid problems associated with the conventional art, in terms of center angle orientation (the tangents to the workpiece W in the two arcuate rocking paths are a horizontally-oriented tangent and a vertically-oriented tangent, that is, they intersect each other). Thus, in the present invention, by virtue of the parallel link mechanism 30, the above-described (vertically-oriented) rocking path $L_2$ can be adopted in the rotary tool 20 of the working head 4, wherefore the rotary tool 20 can be separated (moved upward) from and brought into contact (moved downward) with the workpiece W positioned by the work setting section 3 while being restrained against needless contact with the workpiece W. This makes it possible to avoid damage to the workpiece W.

On the other hand, in the operation switching section 40, by actuating the brake drive source 49 to release the lock condition of the brake plate 47, the clamp rod 48 is returned to its retracted state against the action of the spring 52, thereby permitting free relative rotation of the base shaft 42 and the base link 38. That is, the base link 38 is held for free rocking motion to the rocking base part 27.

Accordingly, although the rocking lever 26 is non-rockably at rest, the working head 4 is kept in an oscillatable state by the trunnion support portion 33, wherefore the following advantageous effect afforded by the trunnion support portion 33 can be attained: the angle of intersection of the workpiece W-contacted surface of the rotary tool 20 and the rotation axis P of the rotary tool 20 can be maintained invariant even when the workpiece W positioned by the work setting section 3 becomes smaller and smaller (in diameter) as machining process proceeds.

Thus, switching between enabling and disabling of the oscillating movement of the working head 4 relative to the rocking lever 26 can be done by making selection between deactivation and activation of the brake drive source 49 of the operation switching section 40. When it is desired to retract (raise) the rotary tool 20 of the working head 4 to separate it from the workpiece W positioned by the work setting section 3, the brake drive source 49 has to be deactivated to bring the brake plate 47 into the lock condition without fail.

Figure 9:
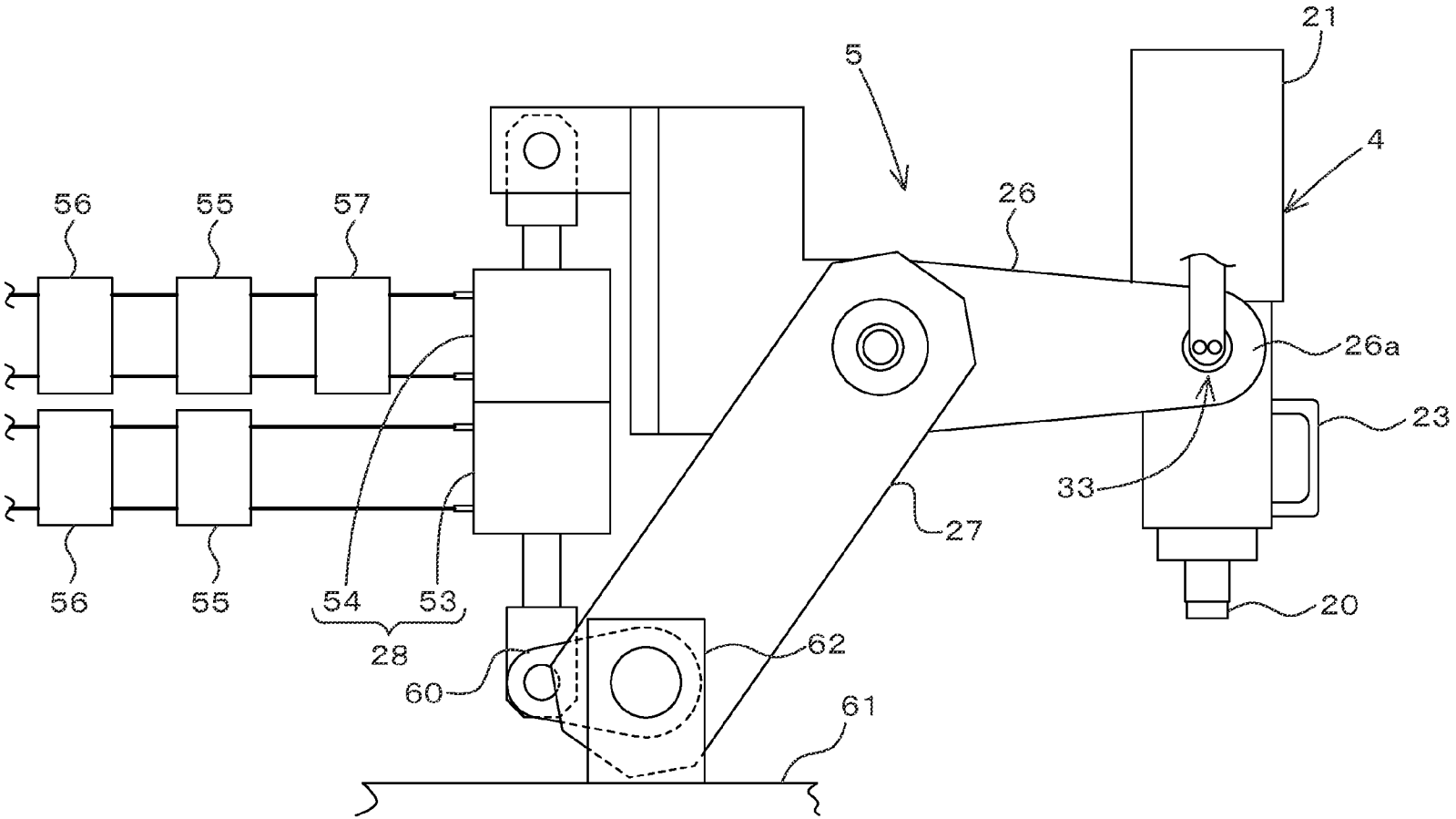
FIG. 9 is a side view showing a rocking unit.

As shown in FIG. 9, the rocking unit 28 for rocking the rocking lever 26 is disposed in a condition to impart a drive to the rocking lever 26 to raise and lower its rear end. Specifically, as will hereafter be described, a rocking support 62 is placed on a unit base 61, and the rocking base part 27 is held for free rocking motion to the rocking support 62, and also, a joint member 60 is disposed in a position acting as the fulcrum axis of the rocking base part 27, and the rocking unit 28 is situated between the joint member 60 and the rear end of the rocking lever 26. It is noted that the rocking support 62 and the joint member 60 are not essential components, and may therefore be omitted. In this case, the bottom end of the rocking unit 28 may be directly coupled to the unit base 61.

The rocking unit 28 is constructed by coupling a movement driving section 53 and a pressurization driving section 54 in a serial arrangement. As employed herein, the term "serial arrangement" refers to an arrangement of both driving sections 53 and 54 such that a driving force exerted by the movement driving section 53 and a driving force exerted by the pressurization driving section 54 are presented in a mutually-connected array form. Accordingly, a plurality of arrangement forms will be considered, i.e. an arrangement wherein the movement driving section 53 and the pressurization driving section 54 are coupled to each other at their tail sides; an arrangement wherein the movement driving section 53 and the pressurization driving section 54 are coupled to each other at their driving sides; and an arrangement wherein the movement driving section 53 and the pressurization driving section 54 are so placed that the tail side of one of them is coupled to the driving side of the other.

It is noted that the arrangement such that a driving force exerted by the movement driving section 53 and a driving force exerted by the pressurization driving section 54 are presented in coaxial relation (uniaxial arrangement) is not a requirement, wherefore an arrangement with some axial deviation is permissible. Accordingly, for example, it is possible to adopt an arrangement such that a plurality of the movement driving sections 53 or the pressurization driving sections 54, or a plurality of both the movement driving sections 53 and the pressurization driving sections 54, are placed in parallel. The movement driving section 53 is constructed of an actuator which is operated with a compressible fluid (air or other gas) used as an operation source. For example, an air cylinder is used for the movement driving section 53. The movement driving section 53 is connected, at its drive control system, to an electromagnetic valve 55, and is also connected to an electropneumatic regulator 56 capable of controlling compressible-fluid supply pressure arbitrarily in proportion to electric signals.

The pressurization driving section 54 is constructed of an actuator which is operated with a compressible fluid (air or other gas) used as an input source, and with an incompressible fluid (water or oil) used as an operation source. For example, an air-hydro cylinder is used for the pressurization driving section 54. The pressurization driving section 54, utilizing a compressible fluid as its input source, is also connected, at its drive control system, to the electromagnetic valve 55 and the electropneumatic regulator 56. In addition, an air-hydro converter 57 is connected to the pressurization driving section 54 which utilizes both a compressible fluid and an incompressible fluid.

In the rocking unit 28 comprising the movement driving section 53 and the pressurization driving section 54, a driving force exerted by the movement driving section 53 is utilized to move the working head 4 between the working-state position and the retracted-state position relative to the workpiece W positioned by the work setting section 3. This makes it possible to accomplish high-speed working head 4 movement, and thereby attain the advantage of shortening an operation cycle.

On the other hand, a driving force exerted by the pressurization driving section 54, or equivalently a pressing force derived from an incompressible fluid, is utilized to press (apply pressure to) the working head 4 in contact with the workpiece W against the workpiece W for machining process. This makes it possible to ensure stable positioning of the working head 4 (rotary tool 20), and thereby attain the advantage of preventing occurrence of machining vibration (chattering), for example. Moreover, the pressurization driving section 54 brings the rotary tool 20 into proper alignment with the workpiece W with a high degree of precision in accordance with the extent of wear in the rotary tool 20. Furthermore, even with the progression of wear in the rotary tool 20 or a decrease in size of the workpiece W entailed by proceeding of machining process, highly accurate following movement can be imparted to the working head 4.

In the rocking unit 28, since the electropneumatic regulator 56 is adopted for each of the movement driving section 53 and the pressurization driving section 54, it is possible to exercise control in a manner such that the driving sections 53 and 54 are subjected to the same supply pressure, and that the supply pressure for one of the driving sections 53 and 54 is slightly higher than that for the other (for example, the supply pressure for the movement driving section 53 is slightly higher than that for the pressurization driving section 54). Therefore, when a load is abruptly applied to the working head 4 in a direction in which it is pressed back by the workpiece W, a damper effect to absorb the load can be obtained from the movement driving section 53. This makes it possible to, for example, move the working head 4 so as to conform to roughness (major irregularities) of the workpiece W in the early stages of machining process, and thereby avoid damage such as a surface flaw to the workpiece W. As another advantage, the working head 4 (rotary tool 20, in particular) can be protected from breakage.

Figure 10A:
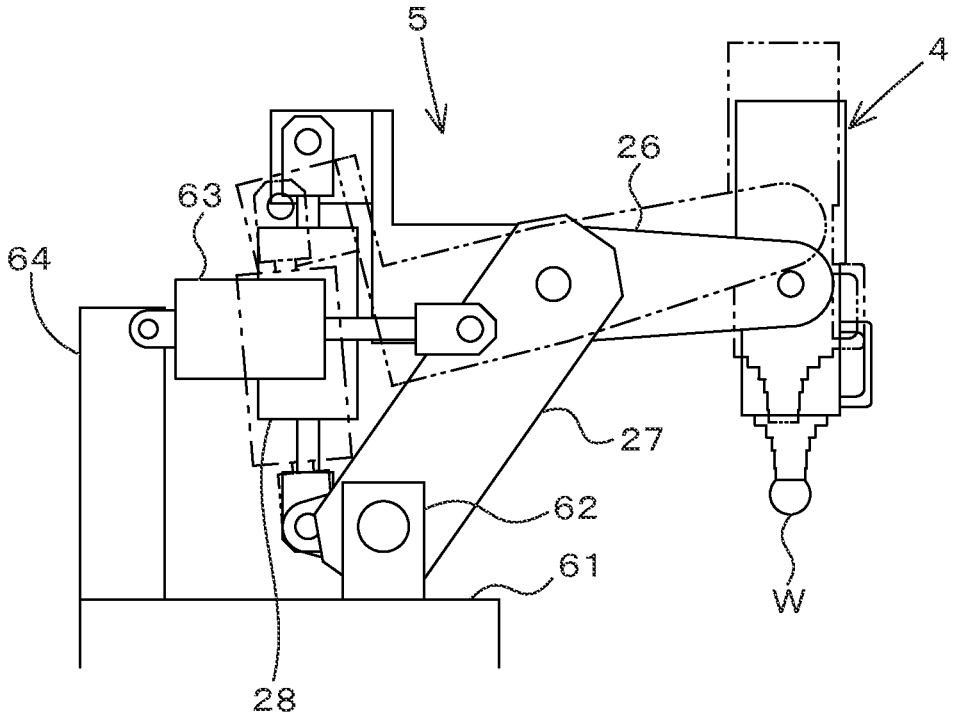
FIG. 10A is a side view showing a condition of operation of the rocking unit.
Figure 10B:
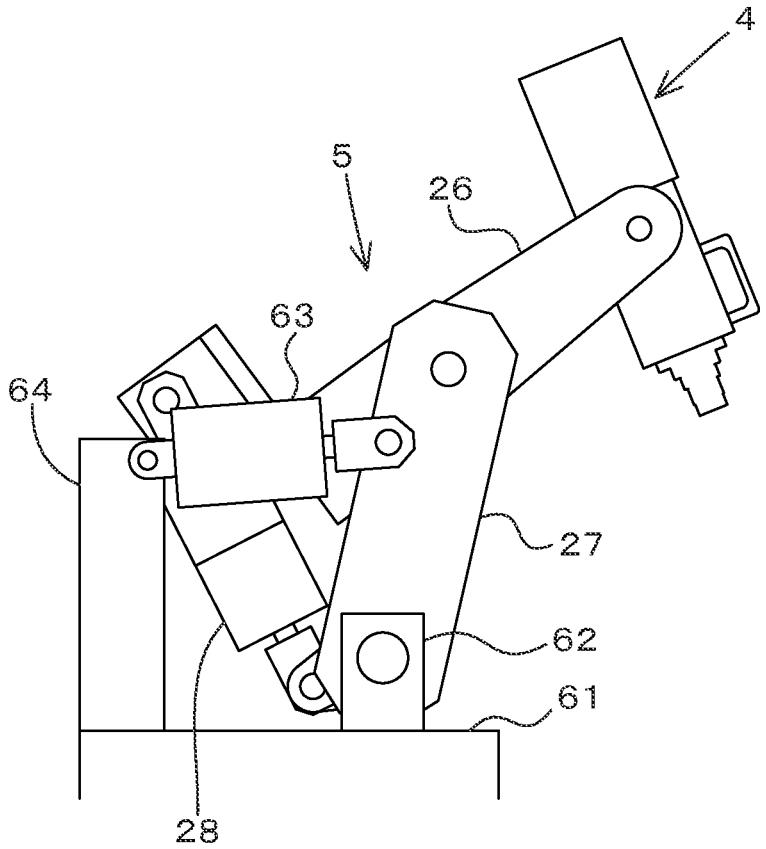
FIG. 10B is a side view showing a condition of operation of the rocking unit.

In this embodiment, in the interest of ease in changing of the workpiece W, replacement of the rotary tool 20, and various maintenance operations for the working head 4 and so forth, as shown in FIGS. 10A and 10B, the rocking base part 27 is designed to be rockable about the rocking support 62 acting as a pivotal point disposed on the unit base 61 (refer also to FIG. 9), and, an actuator for maintenance 63 is installed so as to provide coupling between the rocking base part 27 and a pillar-like bracket 64 situated behind the rocking base part 27. For example, an air cylinder is used for the actuator 63.

Therefore, as shown in FIG. 10A, while the rocking unit 28 is used as above described in the case of moving the rotary tool 20 close to and away from the workpiece W, in the maintenance operation, as shown in FIG. 10B, the working head 4 can be moved greatly upward by operating the maintenance actuator 63.

In this way, changing of the workpiece W can be effected by means of a handling device or otherwise, which is so conducive to energy saving, automation, highly-efficient operation, and so forth.

Figure 11:
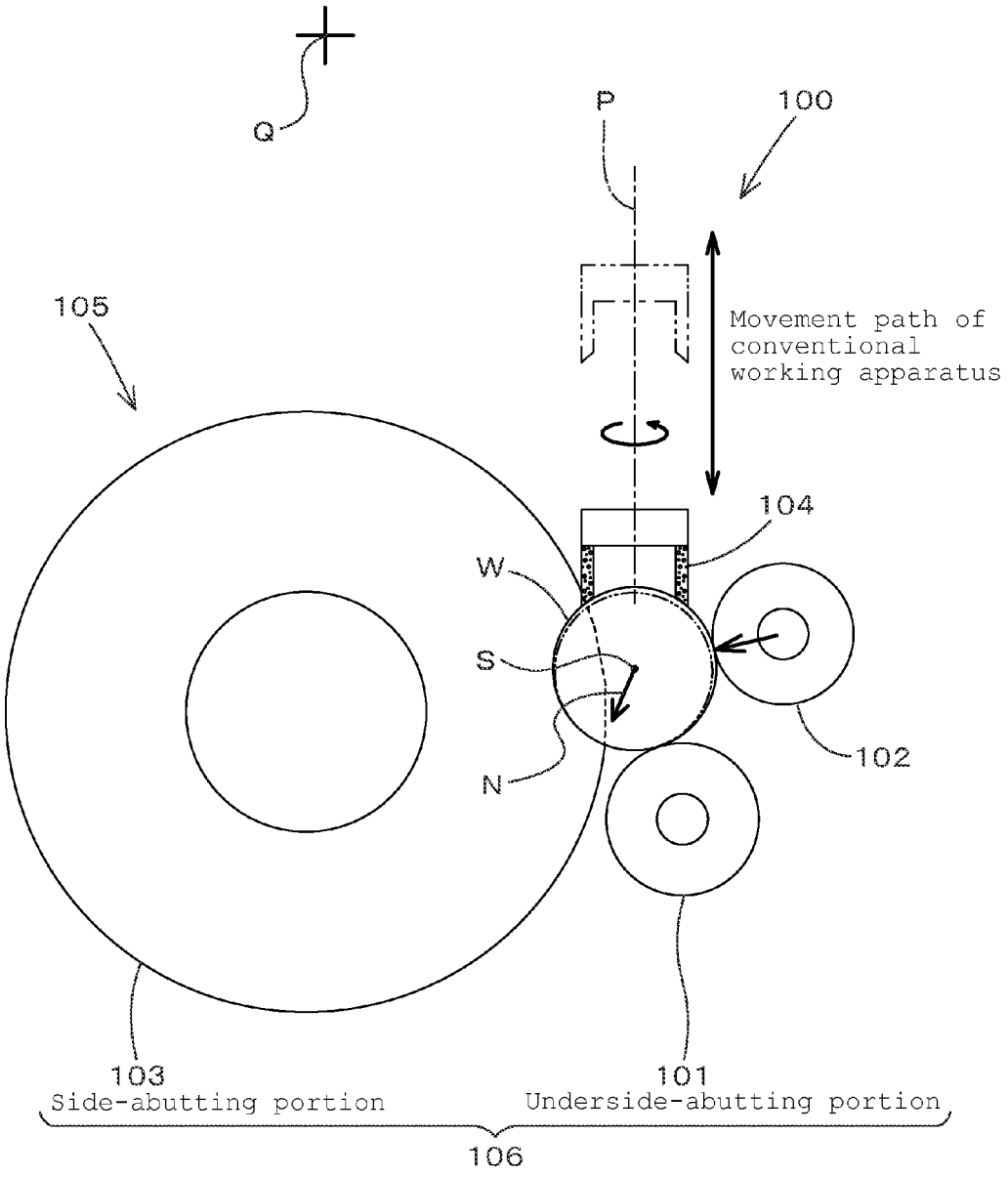
FIG. 11 is a view schematically showing a conventional working apparatus.
Figure 12:
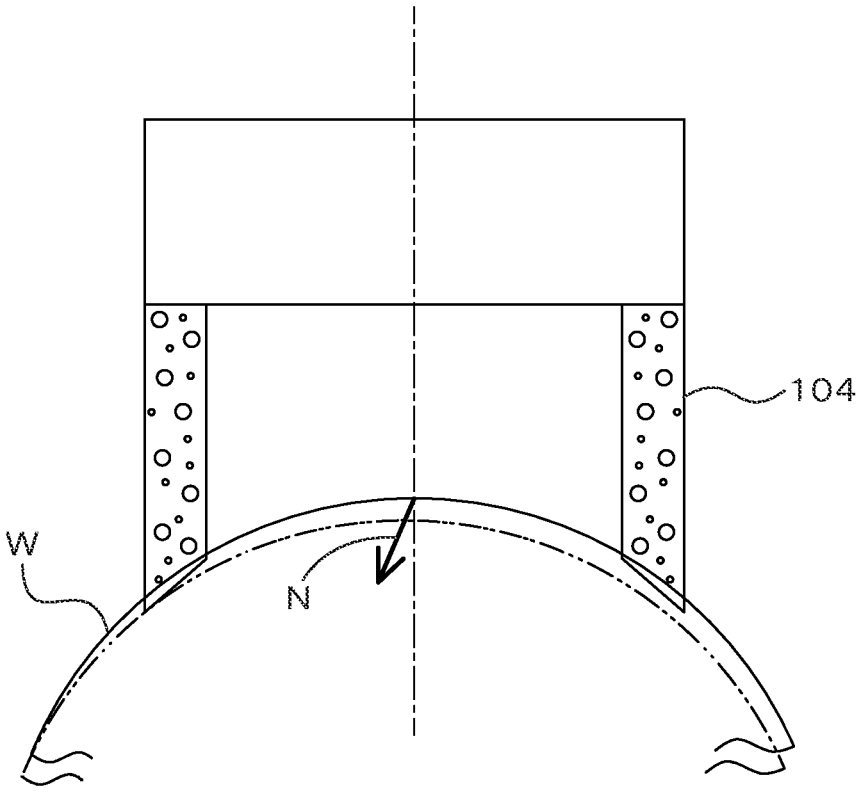
FIG. 12 is an enlarged view for explaining a problem associated with the conventional working apparatus.

As is apparent from the foregoing detailed description, in the working head moving device 1 pursuant to the present invention, the workpiece W supported on the work setting section 3 becomes smaller and smaller, while being kept in contact with the underside-abutting portion 10 and the side-abutting portion 11, as machining process proceeds, and, even if a spherical center S (refer to FIG. 11) moves obliquely, since the working head 4 is retained via the trunnion support portion 33, it follows that the condition where the rotary tool 20 is making contact with the workpiece W can be maintained with stability. This makes it possible to avoid occurrence of the one-sided abutment phenomenon (refer to FIG. 12) posed as a problem associated with the conventional art, and thereby perform machining on the workpiece W with high degrees of uniformity and precision.

Figure 13:
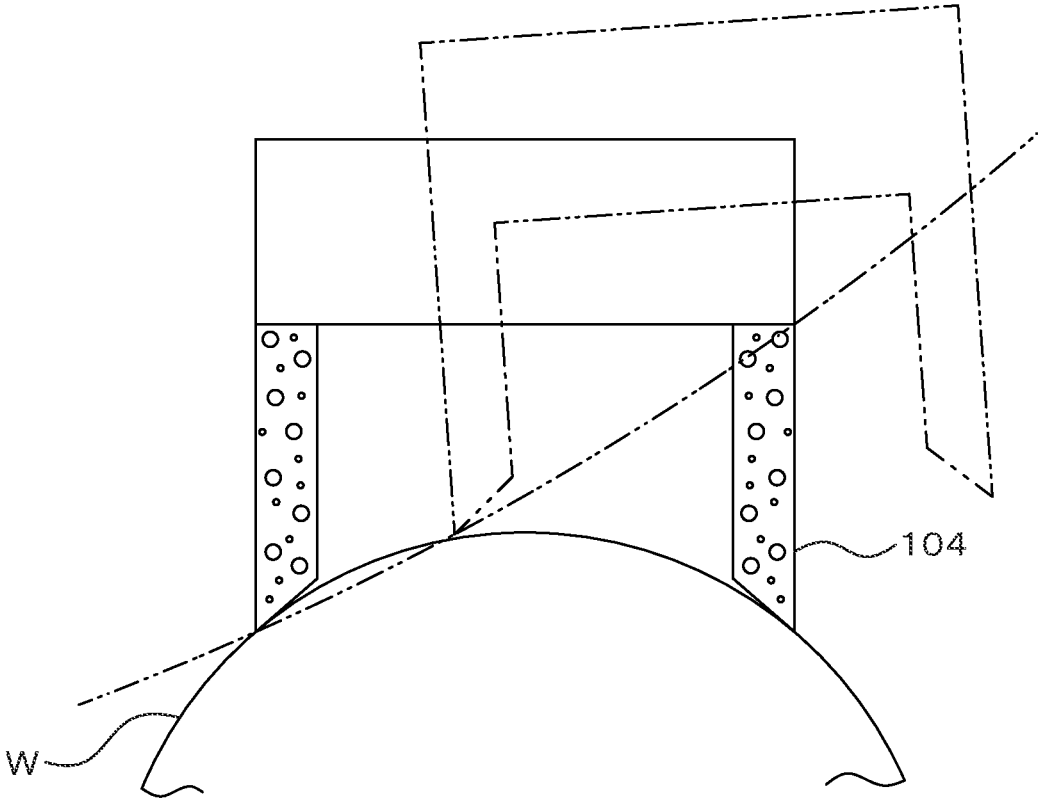
FIG. 13 is an enlarged view for explaining the second problem associated with the conventional working apparatus.

Moreover, since the working head 4 is moved by the rocking lever 26 provided with the parallel link mechanism 30, it never occurs that the rotary tool 20 interferes with the workpiece W during the retracting movement, wherefore there is no risk of occurrence of a flaw in the workpiece W posed as a problem associated with the conventional art (refer to FIG. 13).

As described heretofore, it is possible to maintain proper machining conditions with adaptability to a decrease in size of the workpiece W entailed by proceeding of machining process, and thereby perform machining on the workpiece W with high degrees of uniformity and precision. Moreover, the working head can be moved without causing any damage to the workpiece W.

It should be understood that the present invention is not limited to the embodiments described hereinabove, and therefore various changes and modifications can be made on the basis of the embodiments.

For example, the rotary tool 20 of the working head 4 is not limited to a cup-type grinding wheel, but may be of another component such as grinding wheels of various shapes, for example, a columnar grinding wheel, a grinding wheel shaped like a frustum of a cone, and a ball-like grinding wheel, or a cutting tool such as an end mill.

Although the work setting section 3 is illustrated as being so designed that the paired tapered rollers 13 do double duty; that is, serve as both the side-abutting portion 11 and the spheric rotation driving section 16, this does not suggest any limitation. The side-abutting portion 11 and the spheric rotation driving section 16 can be provided independently of each other. Moreover, the form of each of the underside-abutting portion 10 and the side-abutting portion 11 can be altered as required in accordance with the shape of the workpiece W, and also, the structure of contact between each of the portions 10 and 11 and the workpiece W can be altered.

Although the head moving system 5 is illustrated as having the parallel link mechanism 30, this does not suggest any limitation. For example, a four-link mechanism such as a trapezoidal link (the driven link 37, the base link 38, and the transmission link 39 are designed to have different lengths) can be adopted instead of the parallel link mechanism 30.

The workpiece W is not limited to a spherical body, and therefore, for example, a disk-shaped workpiece, a polyhedron-shaped workpiece, and a prismatic block-shaped workpiece can be a target workpiece.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A working head moving device, comprising:

a work setting section for effecting positioning of a workpiece by means of an underside-abutting portion which supports the workpiece, and a side-abutting portion which abuts on the workpiece to stop its side-to-side movement;

a working head having a rotary tool and a rotatably driving portion for rotating said rotary tool brought into contact with said positioned workpiece; and a head moving system for moving said working head between a working position where said working head is brought into contact with said workpiece and a retracted position separated from said workpiece, wherein said head moving system comprises:

a rocking lever rockably holding said working head via a pivot shaft perpendicular to an axis of rotation of said rotary tool; and a rocking base part for rockably holding said rocking lever via a rocking shaft positioned separately from said pivot shaft, and a driven link extending in a direction perpendicular to said pivot shaft and integrated with said working head;

a base link extending in a direction perpendicular to said rocking shaft with respect to said rocking base part and capable of maintaining an angle of protrusion with respect to said rocking base part constant at least before said working head moves from said working position to said retracted position; and a transmission link for coupling the base link to said driven link, wherein the driven link, the base link and the transmission link constitute a parallel link mechanism, and wherein said pivot shaft and said rocking shaft are parallel.

2. The working head moving device according to claim 1, wherein said parallel link mechanism is provided with an operation switching section for selecting any one of a condition where said angle of protrusion is constant and a condition where said angle of protrusion is released from being constant.

3. A working head moving device, comprising:

a work setting section for effecting positioning of a workpiece by means of an underside-abutting portion which supports the workpiece, and a side-abutting portion which abuts on the workpiece to stop its side-to-side movement;

a working head having a rotary tool and a rotatably driving portion for rotating said rotary tool brought into contact with said positioned workpiece; and a head moving system for moving said working head between a working position where said working head is brought into contact with said workpiece and a retracted position separated from said workpiece, wherein said head moving system comprises:

a rocking lever rockably holding said working head via a pivot shaft perpendicular to an axis of rotation of said rotary tool; and a rocking base part for rockably holding said rocking lever via a rocking shaft positioned separately from said pivot shaft, wherein said pivot shaft and said rocking shaft are parallel wherein said rocking lever is coupled with a rocking unit for imparting a rocking force, wherein said rocking unit comprises:

a movement driving section for making said head moving system move said working head between said working position and said retracted position; and a pressurization driving section for pressing said working head in said working position against said workpiece, and wherein said movement driving section and said pressurization driving section are respectively constructed of actuators which are operated with compressible fluids used as operation sources, and coupled together in a serial arrangement.

* * * * *